US005298638A

United States Patent [19]

Toeneboehn et al.

[11] Patent Number: 5,298,638

[45] Date of Patent: Mar. 29, 1994

[54] ADSORPTIVE REMOVAL OF SULFUR COMPOUNDS FROM FATTY MATERIALS

[75] Inventors: Gabriella J. Toeneboehn, Columbia; William A. Welsh, Highland, both of Md.

[73] Assignee: W. R. Grace & Co.-Conn., New York, N.Y.

[21] Appl. No.: 878,944

[22] Filed: May 5, 1992

[51] Int. Cl.[5] ..... C11B 3/10

[52] U.S. Cl. ..... 554/191

[58] Field of Search ..... 554/191

[56] References Cited

U.S. PATENT DOCUMENTS

| | | | |
|---|---|---|---|
| 4,629,588 | 12/1986 | Welsh et al. | 554/191 |
| 4,734,226 | 3/1988 | Parker et al. | 554/191 |
| 4,781,864 | 11/1988 | Pryor et al. | 554/191 |
| 4,877,765 | 10/1989 | Pryor et al. | 554/191 |
| 4,880,574 | 11/1989 | Welsh . | |
| 4,939,115 | 7/1990 | Parker et al. | 554/191 |
| 5,069,829 | 12/1991 | Van Dalen et al. | 554/191 |

OTHER PUBLICATIONS

Pippen et al., "Determination of Trace Sulfur in Fat by Combustion and Reduction of Sulfate to Hydrogen Sulfide"-*J. Agr. Food Chem.*, 18/301. (1970).

Mork, "Heterogeneous Hydrogenation of Fish Oils: Kinetic Determination of Catalyst Poising"-*JAOCS*, 49/426 (1972).

Daun et al., "Sulfur Content of Rapeseed Oils"-*JAOCS*, 53/169 (1976).

Coenen, "Hydrogenation of Edible Oils"-*JAOCS*, 53/382 (1976).

Daun et al., "Identification of Sulfur Compounds in Rapeseed Oil"-*JAOCS*, 54/351 (1977).

Embong et al., "Sulfur Content of Crude Rapeseed Oil from Aqueous Extraction"-*JAOCS*, 57/75 (1980).

Ahmad et al., "The Effect of Processing Operations on the Total Sulphur Content in Rapeseed Oil"-*JAOCS*, 57/76 (1980).

Rutkowski et al., "Sulfur Compounds Affecting Processing of Rapeseed"-*JAOCS*, 59/7 (1982).

deMan, "Effect of the Presence of Sulfur During the Hydrogenation of Canola Oil"-*JAOCS*, 59/558 (1982).

Abraham et al., "Determination of Volatile Sulfur Compounds in Canola Oils"-*JAOCS*, 62/1025 (1985).

Abraham et al., "Determination of Total Sulfur in Canola Oil"-*JAOCS*, 64/384 (1987).

Abraham et al., "Effect of Some Isothiocyanates on the Hydrogenation of Canola Oil"-*JAOCS*, 64/855 (1987).

Wijeusndera et al., "Evidence for the Probable Presence of Sulfur-Containing Fatty Acids as Minor Constituents in Canola Oil"-*JAOCS*, 65/959 (1988).

Cho-Ah-Ying et al., "Adsorptive Removal of Sulfur from Canola Oil"-*Fat Sci. Tech.*, 93/132 (1991).

Devinat et al., "Sulfur Compounds of Rapeseed Oils", pp. 227-235, 1980.

LeClercq et al., "Sulfur Levels in Canola Oils From Canadian Crushing Plants: Analysis by Raney Nickel Reduction and Inductively Coupled Plasma Atomic Emission Spectroscopy", 1990.

Shahidi, "Hydrogenation of Canola Oil"-*Canola and Rapeseed*, pp. 123-127, 155, 156,291-300, 1989.

Abraham et al., "Removal of Sulfur Compounds from Canola Oil"-*JAOCS* 65/392 (1988).

*Primary Examiner*—José G. Dees
*Assistant Examiner*—D. D. Carr
*Attorney, Agent, or Firm*—Steven Capella

[57] ABSTRACT

A process for removal of sulfur-containing compounds from fatty materials is disclosed, in which the fatty material is contacted with a silica hydrogel. Use of this adsorptive process prior to hydrogenation improves oil quality and decreases hydrogenation times.

11 Claims, No Drawings

ADSORPTIVE REMOVAL OF SULFUR COMPOUNDS FROM FATTY MATERIALS

BACKGROUND OF THE INVENTION

Fatty acid-based materials (fatty materials) such as glyceride oils, wax esters, milk fat, and other fatty acid compounds have a long history of use since many of these materials are naturally derived from plants (e.g., vegetable oils) or animals (e.g., tallow, milk fat, fish oil, etc.).

While these fatty materials often have been directly used in their crude state, for use in modern commercial products, these materials are typically subjected to a refining process. Refining processes may be used to remove various contaminants and impurities which are undesirable for reasons of health, performance, aesthetics, etc.

The fatty material may contain impurities such as color bodies, chlorophyll, phospholipids (phosphatides), trace metals, free fatty acids, gums, soaps, and/or other impurities. This variety of diverse impurities has led to the development of numerous refining processes involving particular combinations of chemical and/or physical treatment steps. A detailed review of refining processes for removal of these impurities may be found in the "Handbook for Soy Oil Processing and Utilization," David R. Erikson et al. (ed.), *ASA/AOCS Monograph* (1980).

Fatty materials may also comprise sulfur, either in the form of naturally occurring sulfur compounds or in the form of contaminants from various processing or refining steps. For example, certain glyceride oils, most notably canola and rapeseed oils are known to contain small amounts of sulfur in the form of episulfides, isothiocyanates, thiocyanates, oxazolidinethiones, sulfates and sulfur-containing fatty acids. These oil soluble sulfur compounds are the product of enzymatic decomposition of sulfur-containing glucosinolates in the plant seed, which occurs during processing of the seed. Fish oils are also known to comprise naturally occurring sulfur-containing compounds. Substantial proportions of sulfur are removed in degumming and alkali refining operations, but refined canola oils, for example, may still contain up to 9 or more ppm sulfur.

Sulfur compounds present both aesthetic and refining problems, They are implicated in the production of unpleasant odors during heating of the oils or other fatty materials. In addition, these sulfur compounds poison the catalysts used during hydrogenation, resulting in either increased catalyst usage (with a corresponding increase in the disposal burden) or longer hydrogenation times resulting in lower production rates. This is an economically important consideration, since enormous quantities of fatty materials are hydrogenated, a reaction in which some of the double bonds are removed in order to alter the material's viscosity (e.g., converting canola oil into margarine). Sulfur has not been found to be removed during conventional refining or oil treatment methods to sufficient extents to avoid problems in hydrogenation. In fact, total sulfur content may increase during treatment with activated bleaching earth (ABE).

One effect of the poisoning of nickel hydrogenation catalysts by sulfur is a shift in selectivity toward increased isomerization of triglyceride double bonds from the naturally occurring cis olefin isomer to non-naturally occurring trans olefin isomer. This reaction is thought to occur when a triglyceride fatty material adsorbs on the catalyst but is not hydrogenated before desorption. The increased trans isomer content typically raises the melting point but also has been cited as a health issue relative to the more naturally occurring cis isomer.

The presence of cis and trans isomers can be studied by infrared spectroscopy while the level of unsaturation can be quantified by NMR techniques. Thus, the ratio of cis-to-trans can be calculated and compared at a constant level of double bond hydrogenation. Higher cis/trans ratios would be observed when a catalyst was less sulfur poisoned. Thus, one possible result of adsorptive sulfur removal prior to hydrogenation would be less trans isomer and therefore a higher cis/trans ratio, resulting in a more natural product.

F. Cho-Ah-Ying et al., "Adsorptive Removal of Sulfur from Canola Oil,"*Fat. Sci. Technol.*, No. 4, pp. 132–5 (1991), describes an investigation of physical adsoprtion of sulfur using alumina, alumina-silicate, diatomaceous silica and TriSyl ® silica gel (Davison Division, W. R. Grace & Co.-Conn.) in conjunction with bleaching earths. The article reports that compared to the unactivated TriSyl ® silica gel, the activated adsorbent (dried at 240° C. for three hours) had a higher capacity for adsorbing Raney ® nickel sulfur at all concentrations used. For that reason, Cho-Ah-Ying opted to use the activated silica gel adsorbent throughout the experiments. The article reports that the addition of 2 or 4% alumina, alumina-silicate, diatomaceous silica and silica gel (presumably the unactivated form) did not further improve the removal of sulfur.

SUMMARY OF THE INVENTION

The invention provides a physical adsorption process for the removal of sulfur compounds from fatty materials. Amorphous silica hydrogels have been found to exhibit excellent capacity for adsorption of the enzymatic decomposition products of sulfur-containing glucosinolates. This process for removal of sulfur compounds from fatty materials comprises:

(a) selecting a fatty material comprising sulfur-containing compounds;

(b) selecting a silica hydrogel;

(c) contacting the fatty material of step (a) and the silica hydrogel of step (b); and (d) allowing sulfur to be adsorbed onto said silica hydrogel.

This may be followed by a drying step, and by separation of the silica hydrogel from the sulfur-depleted fatty material.

The invention also provides a process for decreasing hydrogenation times for the hydrogenation of fatty materials using hydrogenation catalysts, in which the fatty material is treated by contact with a silica hydrogel prior to hydrogenation to reduce the level of sulfur-containing compounds in the fatty material.

In addition, the invention provides an improved hydrogenated fatty material, having an increased cis-to-trans olefin isomer ratio. The sulfur adsorption process decreases isomerization of cis isomers to trans isomers, which typically are formed as a result of poisoning of the hydrogenation catalyst.

Preferably, the silica hydrogel used in this process has a total volatiles content of, at least about 25 wt. %. In alternative embodiments, the silica hydrogel is treated with an acid selected from an organic acid, and inorganic acid or an acid salt.

DETAILED DESCRIPTION OF THE INVENTION

Broadly, the invention relates to the treatment of any fatty material comprising sulfur-containing compounds where the fatty material is contacted with a silica hydrogel for purposes of removing sulfur compounds from the fatty material. More specifically, silica hydrogels have been found to be effective for adsorption of enzymatic decomposition or hydrolysis products of sulfur-containing glucosinolates. Removal of these compounds from fatty materials improves the quality of those materials, since the sulfur compounds cause unpleasant odors upon heating. Important economic benefits can also be realized by the removal of these sulfur compounds, which poison hydrogenation catalysts, particularly nickel hydrogenation catalysts. The result is an improved hydrogenation operation, either by reduction in hydrogenation times or catalyst usage.

The Fatty Materials

As discussed above, the fatty materials may be glyceride oils, wax esters, milk fat or other fatty acid compounds. This invention is expected to be of particular importance in the processing of canola or rapeseed oils, and the processing of wet-milled corn oil and fish oils, which comprise the offending sulfur-containing compounds. However, the process of the invention can be used for any fatty material comprising sulfur-containing compounds, such as episulfides, isothiocyanates, thiocyanates, oxazolidinethiones, and sulfur-containing amino acids. Decomposition products of isothiocyanates (hydrogen sulfide and other sulfides) are especially active catalyst poisons and are also considered "sulfur-containing compounds" as that term is used herein.

Corn oil also contains sulfur compounds, although from different sources. Natural sulfur compounds may be absorbed and metabolized from the soil as nutrients, In addition, during wet milling, $SO_2$ is added as a preservative, and the resulting sulfur content of corn oil may be about 20–30 ppm. The $SO_2$ will react with cysteine and cystine to form trace amounts of sulfur-containing proteins in the oil. Fish oils, for example, mackeral oil, contain naturally occurring sulfur compounds. Other fatty materials may contain or become contaminated with sulfur compounds which may be removed by the process of this invention.

The fatty material may be treated according to the invention at any convenient time or stage in refining or treatment. Most preferably, the fatty material will be treated prior to hydrogenation, in order to maximize the benefits to the hydrogenation process.

The Silica Hydrogel Adsorbent

The adsorbent used for the sulfur removal of this invention will be a silica hydrogel. It has been found that amorphous silica hydrogels have an affinity for the types of sulfur-containing compounds described above and can be used quite effectively in a process for the adsorptive removal of those compounds from fatty materials. This is a surprising discovery, since the Cho-Ah-Ying article discussed above teaches that activated (dried) silicas are preferred for this purpose.

According to the present invention, silica hydrogel adsorbents are used, with the silica hydrogel component of the adsorbent having a total volatiles content ("TV") of at least about 25 wt. %, preferably at least about 40 wt. %, most preferably at least about 65 wt. %. The adsorbent may be used with other compositions which are either inert to the fatty material and its contaminants, or which are present for the purpose of removing one or more other contaminants from the fatty material (that is, contaminants other than sulfur-containing compounds). For example, the silica hydrogel may be used in conjunction with bleaching earth for the removal of trace metals and/or color bodies.

The particle size of the silica hydrogel is not believed to be critical to the invention, but will be selected on the basis of operating requirements. It will be preferred to use particle sizes up to about 250 microns, but that is not required.

Generally, fines $<3$ microns are to be avoided due to filtration problems. Ultra large ($>250$ micron) particles may present adsorption problems due to diffusion resistance. Preferably the adsorbent would be used at a loading (weight %, as is based on oil to be treated) of 0.05–5.0%, more preferably at 0.1–4.0% and most preferably at 0.1–2.0%.

The purity of the amorphous silica used in this invention is not believed to be critical in terms of the adsorption of phospholipids. However, where the finished products are intended to be food grade oils care should be taken to ensure that the silica used does not contain leachable impurities which could compromise the desired purity of the product(s). It is preferred, therefore, to use a substantially pure amorphous silica, although minor amounts, i.e., less than about 20%, preferably less than 10%, of other inorganic constituents may be present. For example, suitable silicas may comprise iron as $Fe_2O_3$, aluminum as $Al_2O_3$, titanium as $TiO_2$, calcium as CaO, sodium as $Na_2O$, zirconium as $ZrO_2$, and/or trace elements.

In addition to standard amorphous silica hydrogels, acid-treated hydrogels may be used as the adsorbents of this invention. If desired, a mixture of standard and acid-treated hydrogels may be used. Acid-treated hydrogels may be prepared by treating a silica hydrogel with an organic or inorganic acid or an acid salt such that acid is retained in the pores of the hydrogel, for example, as taught in U.S. Pat. No. 4,877,765 and U.S. Pat. No. 4,939,115. That is, organic acids such as citric acid, tartaric acid, etc., or inorganic acids such as sulfuric acid, phosphoric acid, hydrochloric acid, etc., may be used. The acid-treated hydrogel may be prepared by slurrying the silica hydrogel in an acidic solution, or by any other manner which is convenient, such as by the methods described in the above-mentioned U.S. patents.

The Treatment Process

The adsorption process of this invention may be conducted in any manner which provides adequate contact between the hydrogel and the fatty material to promote adsorption of sulfur on the adsorbent. The treatment protocol will depend on the refinery set-up, and its selection would be within the knowledge and ability of one of ordinary skill in the art. Contact may be by batch or continuous processing, so long as sufficient contact is maintained between the fatty material and the silica hydrogel to effect the adsorption.

The fatty material may be treated at any convenient temperature at which it is a liquid. It is preferred, however, to heat the fatty material to about 40°–160° C., most preferably between 70° to 120° C. The adsorption of this invention may be conducted under vacuum, or at atmospheric pressure. Temperature and pressure should be selected to protect the fatty material from damage. For example, at atmospheric pressure and with exposure to air, it will be preferred to operate below about 70° C., whereas with the use of vacuum, the fatty material may tolerate temperatures up to about 260° C.

Following this treatment, the silica hydrogel is removed from the fatty material. Removal of the sulfur-containing adsorbent preferably occurs prior to the hydrogenation of the fatty material. However, the adsorbent need not be removed immediately following contact with the fatty material, and it may be convenient to subject the fatty material to other processing steps prior to adsorbent removal. For example, the fatty material may be contacted with an additional adsorbent for removal of chlorophyll or other contaminants, after which both the sulfur-adsorbent and the chlorophyll-adsorbent may be removed simultaneously in a single step.

Any convenient separation may be employed. It may be most convenient to remove the adsorbent from the fatty material by filtration. Alternative methods, such as centrifugation or settling, will be acceptable from the standpoint of sulfur removal, although they may be less economical in the overall context of a refinery.

The sulfur-depleted fatty material may then be used or processed as desired. For glyceride oils, it is expected that hydrogenation would be the most frequent subsequent processing step. It is now known that removal of sulfur-containing compounds by adsorption onto amorphous silica hydrogels will reduce hydrogenation times and therefore hydrogenation catalyst usage. This removal of sulfur compounds also yields a hydrogenated product having an unusually high ratio of cis-to-trans olefin isomers, preferably a ratio greater than 5.0.

The examples which follow are given for illustrative purposes and are not meant to limit the invention described herein. The following abbreviations have been used throughout in describing the invention:

| | |
|---|---|
| °C. | degrees Centigrade |
| °F. | degrees Fahrenheit |
| FTIR | Fourier Transformed Infrared |
| gm | gram(s) |
| ICP | inductively coupled plasma emission spectroscopy |
| kg | kilogram(s) |
| ppm | parts per million |
| RI | refractive index |
| rpm | revolutions per minute |
| wt. % | weight percent |

EXAMPLE I

Sulfur Removal

A super degummed canola oil containing 5.8 ppm total sulfur was used in this example. Sulfur analysis was measured by inductively coupled plasma (ICP) atomic emission spectroscopy. The silica hydrogel adsorbent used was TriSyl® silica hydrogel (Davison Division, W. R. Grace & Co.-Conn.). Control Adsorbent #1 was a dried silica hydrogel (TriSyl® silica oven dried at 200° C. for 2 hours). Control Adsorbent #2 was a commercial premium activated bleaching earth (ABE).

Adsorptive treatments were conducted by heating multiple 300.0 gm batches of canola oil in a glass flask for 20 minutes in a water bath to 70° C. Adsorbent was then added to the level indicated in Table I and stirred into the oil with a mixer set at 1400 rpm. The flask was transferred to a 100° C. water bath and placed under vacuum at 60 torr pressure for 40 minutes with continued stirring. The oil was then removed from the bath and cooled to below 70° while vacuum was maintained. The vacuum was then disconnected and the adsorbent filtered from the oil.

Table I shows the results in terms of total sulfur remaining in each treated oil sample. The observed performance of the dried silica gel (Control Adsorbent #1) was consistent with the literature reports that dried silica reduces sulfur content. The ABE (Control Adsorbent #2) was ineffective in reducing total sulfur. The performance of the silica hydrogel adsorbent was surprisingly better than expected based on the literature, particularly when considered on a silica basis, as shown in Table I (last column). On that basis, the silica hydrogel outperformed the dried silica control.

TABLE I

| | Usage Level (wt. %) | | | | |
|---|---|---|---|---|---|
| Treatment | TV (wt. %)[1] | As Is | Dry Basis[2] | Total Sulfur[3] | Adsorbed Sulfur[4] |
| No adsorbent | — | — | — | 5.8 | — |
| Control #1 | 5.9 | 1.0 | 0.95 | 3.6 | 231 |
| Control #1 | 5.9 | 3.0 | 2.85 | 2.0 | 133 |
| Control #2 | 17.8 | 3.5 | — | 6.0 | — |
| Hydrogel | 64.6 | 1.5 | 0.52 | 2.6 | 615 |
| Hydrogel | 64.6 | 3.0 | 1.04 | 2.5 | 317 |

[1]Total volatiles measured by weight loss on ignition at 1750° F. (955° C.).
[2]Dry basis (or silica basis) is calculated as weight of adsorbent following removal of moisture as in Note 1.
[3]Total sulfur measured by ICP (ppm).
[4]Sulfur adsorbed, on a silica basis (mg S/kg $SiO_2$ (dried basis)).

EXAMPLE II

Hydrogenation

After the adsorbent treatments of Example I, quantities of the treated oil samples were then bleached by treatment with ABE as required to obtain oil with low phosphorus and chlorophyll A levels consistent with specifications for pre-hydrogenation glyceride oil (typically <1.0 ppm phosphorus and <0.05 ppm ChlA). Oils treated in Example I with Control Adsorbent #2 were not separately treated here with ABE.

The treated oil samples were then hydrogenated in a stirred tank reactor, under nonselective conditions, using refractive index (RI) at 40° C. as an in-process measure of the degree of hydrogenation. Detailed hydrogenation conditions were as follows:

180° C.
30 psi
600 rpm agitation
500 gm oil samples from combined Example I batches
0.01 wt. % Ni-AOCS Reference Catalyst #2*
Endpoint: RI=1.4616 at 40° C.

*The AOCS Reference #2 Nickel Catalyst is available from the American Oil Chemists Society, P.O. Box 3489, Champaign, Ill. 61826-3489.

The endpoint was an RI of 1.4616, selected to approximate an iodine value of 80. The time to achieve that RI was measured to compare catalyst efficiency (an indirect measure of the success of the adsorbent treatment in protecting the catalyst from sulfur poisoning). Results are shown in Table II, where it can be seen that treatment With the silica hydrogel adsorbent of the invention resulted in a substantial reduction of hydrogenation time, which corresponds to the sulfur reduction seen in Example I.

TABLE II

| Treatment | Usage (wt. %) (As Is) Silica | ABE | Treated Oil Analyses (ppm)[1] P | ChlA | S | Hydrogenation Time (min.) |
|---|---|---|---|---|---|---|
| No adsorbent | — | — | 12 | 22 | 5.8 | — |
| Control #1 + ABE | 1.0 | 2.50 | <.03 | .04 | 4.9 | 180 |
| Control #1 + ABE | 3.0 | 1.75 | <.03 | .05 | 3.6 | 75 |
| Control #2 only | — | 3.50 | <.03 | .04 | 6.0 | 360 |
| Hydrogel + ABE | 1.5 | 2.65 | <.03 | .06 | 4.0 | 90 |
| Hydrogel + ABE | 3.0 | 1.90 | <.03 | .05 | 4.2 | 107 |

[1]Measured by ICP emission spectroscopy.

EXAMPLE III

Oils from Example II were compared after hydrogenation for their cis and trans isomer contents. Fourier Transformed Infrared (FTIR) data were collected for each sample in duplicate or triplicate using a Nicolet 205 FTIR (32 scans, 4 $cm^{-1}$ resolution, capillary film between salt plates). Peak intensities were obtained by integrating over a defined, baseline-corrected spectral region. The results are listed in Table III showing the ratio of integrated bands for trans (915–870 $cm^{-1}$) and cis (750–700 $cm^{-1}$) double bonds. The precision of the FTIR peak intensity calculation is estimated to be 10% relative.

TABLE III

| | Usage (wt. % (As Is) Silica | ABE | Cis/Trans Ratio |
|---|---|---|---|
| Control Adsorbent #2 only | — | 3.5 | 4.6 |
| Hydrogel + ABE | 3.0 | 1.9 | 12.0 |

What is claimed is:

1. A process for reducing total sulfur content of fatty materials containing commercially acceptable levels of phospholipids and chlorophyll by removal of sulfur-containing compounds from said fatty materials, said process comprising (a) contacting the fatty material with a silica hydrogel said hydrogel having a volatiles content of at least 25 wt. %;

(b) allowing said sulfur compounds to be absorbed onto said silica hydrogel thereby lowering the total sulfur content in said fatty material; and (c) separating said hydrogel from said lwoer total sulfur content fatty material.

2. The process of claim 1 in which said fatty material is selected from the group consisting of glyceride oils, wax esters, milk fat, other fatty acid compounds and mixtures thereof.

3. The process of claim 1 wherein said fatty material comprises canola oil.

4. The process of claim 3 in which said oil is caustic refined canola or rapeseed oil.

5. The process of claim 1 wherein said fatty material comprises fish oil.

6. The process of claim 1 wherein said fatty material comprises corn oil.

7. The process of claim 1 in which said sulfur-containing compounds are enzymatic decomposition products of sulfur-containing glucosinolates.

8. The process of claim 1 in which said sulfur-containing compounds are naturally occurring components of the fatty material.

9. The process of claim 1 in which said sulfur-containing compounds are selected from episulfides, thiocyanates, isothiocyanates, sulfates, oxazolidemethiones, sulfur-containing amino acids, and mixtures thereof.

10. The process of claim 1 in which the silica hydrogel has been treated with an acid selected from an organic acid, inorganic acid or acid salt.

11. The process of claim 1 wherein said contacting step (b) is performed at a temperature of about 70°–100° C.

* * * * *